US005261644A

United States Patent [19]

Armstrong

[11] Patent Number: 5,261,644

[45] Date of Patent: Nov. 16, 1993

[54] PLASTIC JACK

[75] Inventor: Bruce Armstrong, Stroud, Canada

[73] Assignee: Seeburn Metal Products Limited, Tottenham, Canada

[21] Appl. No.: 957,889

[22] Filed: Oct. 8, 1992

[51] Int. Cl.[5] ..... B66F 3/22

[52] U.S. Cl. ..... 254/126

[58] Field of Search ..... 269/122, 126, 124, DIG. 1

[56] References Cited

U.S. PATENT DOCUMENTS 3,523,679 8/1970 Clay .
3,695,582 10/1972 Clay .
3,737,147 6/1973 Morgan .
4,025,054 5/1977 Yamazaki ..... 254/126
4,624,448 11/1986 Lawman et al. ..... 254/122
4,695,602 9/1987 Crosby et al. .
4,836,502 6/1989 Yamauchi .
4,872,903 10/1989 Periou .
5,139,232 8/1992 Bailey ..... 254/126

FOREIGN PATENT DOCUMENTS 3411634 10/1985 Fed. Rep. of Germany .
2534238 4/1984 France .
2070560 9/1981 United Kingdom .

*Primary Examiner*—Robert C. Watson
*Attorney, Agent, or Firm*—Nixon and Vanderhye

[57] ABSTRACT

A plastic pantograph jack for use in lifting and lowering automobiles comprising arms jointed together between a base and a load rest having a threaded rod passing through a pair of joints of the plastic members to raise or lower the load rest with respect to the base.

1 Claim, 15 Drawing Sheets

PLASTIC JACK

This invention relates to a plastic jack for use in lifting and lowering automobiles for the purpose of temporary repair and the like. In particular, it relates to a jack of a pantograph construction comprising plastic members or arms jointed together between a base and a load rest and having a threaded rod passing through a pair of joints of the plastic members to raise or lower the load rest with respect to the base.

PRIOR ART

Prior art pantograph jacks have been typically manufactured of metal parts. The metal parts usually comprise a pair of upper arms and a pair of lower arms pivotally mounted in relation to each other in the approximate shape of a parallelogram standing on one corner. The bottom corner of the parallelogram is located on a base and the top corner carries a load rest adapted to fit under a vehicle for raising and lowering same. A rod is threaded between the other two corners of the parallelogram in a horizontal plane. The rod is turned clockwise or counterclockwise to vary the distance between these corners and, thereby, to adjust the distance between the top and bottom corners by distorting the parallelogram. A typical pantograph jack is illustrated in U.S. Pat. No. 4,836,502 granted Jun. 6, 1989 to Yamauchi.

Recently efforts have been made to use plastic elements in jacks. The applicant is aware of French patent 2,534,238 filed Oct. 12, 1982 by Guy Poignon and Christian Tournalia which discloses a pantograph jack having plastic elements. It is known that the nature of plastics and the fabrication techniques for the construction of plastic elements present many advantages to a manufacturer. However, the differences in the properties of plastic and metal do not permit the simple substituion of plastic elements for metal elements in the pantograph jack. Instead, it has been found by the applicant that the substitution of plastic for metal in the pantograph jack requires a redesign of the elements and a new combination of parts in order to use the properties of plastic effectively while maintaining a low profile necessary to fit a jack under an automobile and to retain the strength characteristics of comparable metal jacks.

GENERAL DESCRIPTION OF THE INVENTION

The plastic pantograph jack of this invention comprises;

a plastic base having connection means to receive each of two lower channel links in a pivotable connection, two plastic lower channel links each having a first side section and a second side section joined by a grid of support struts, said first side section having a lower end with connection means to connect to the base and first and second gear teeth in a first plane and a third gear tooth in another next adjacent second plane; and having an upper end with connection means to connect pivotally to an upper channel link;

said second side section having a lower end with fourth and fifth gear teeth in a third plane and a sixth gear tooth in another next adjacent fourth plane, said third and fourth planes being in the same relationship to one another as said first and second planes, and said first and second gear teeth being shaped and spaced to mesh with the sixth tooth of a reversed and opposed lower channel link connected to the base, said fourth and fifth gear teeth being shaped and spaced to mesh with a third tooth of a reversed and opposed lower channel link connected to the base, two plastic upper channel links each having a first side section and a second side section joined by a grid of support struts, said first side section having an upper end with connection means to connect to a load rest and first and second gear teeth in a first plane and a third gear tooth in another next adjacent second plane; and having an upper end with connection means to connect pivotally to a lower channel link;

said second side section having an upper end with connection means to connect to a load rest and with fourth and fifth gear teeth in a third plane and a sixth gear tooth in another next adjacent fourth plane, said third and fourth planes being in the same relationship to one another as said first and second planes, and said first and second gear teeth being shaped and spaced to mesh with the sixth tooth of a reversed and opposed upper channel link connected to the load rest, said fourth and fifth gear teeth being shaped and spaced to mesh with a third tooth of a reversed and opposed upper channel link connected to the load rest and a load rest having connection means to receive each of two upper channel links in a pivotable connection.

DESCRIPTION OF THE FIGURES

In the Figures which illustrate the preferred embodiment of this invention.

DESCRIPTION OF PREFERRED EMBODIMENT

In the Figures which represent the preferred embodiment of this invention, like numerals indicate like elements.

Figure 1:
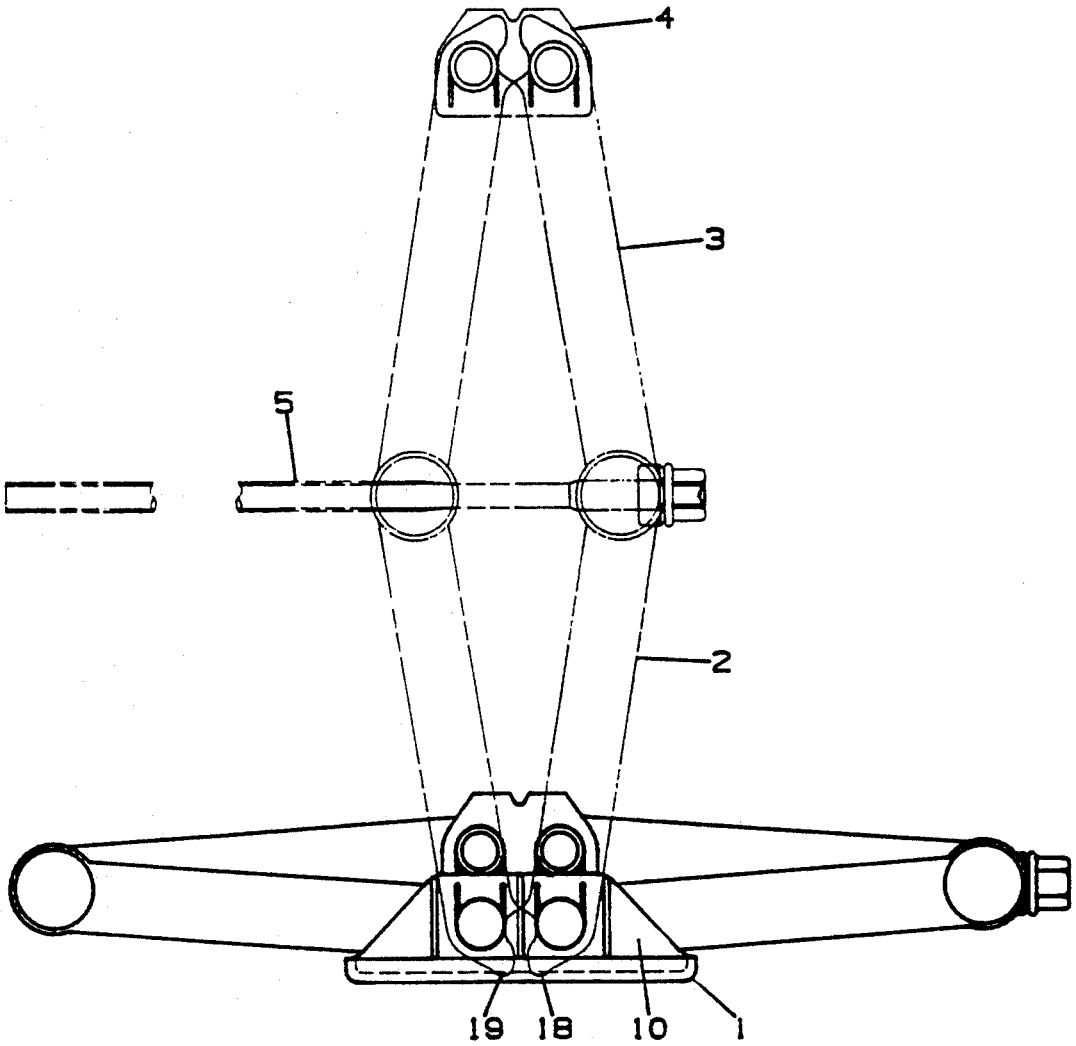
FIG. 1 is a side view of the plastic jack of this invention.

The general elements of the preferred embodiment of this invention may be viewed in combination in FIG. 1. These elements comprise a base (1), two lower channel links (2), two upper channel links (3), a load rest (4) and an operating screw (5). In FIG. 1 the jack is shown in raised and lowered positions with the raised position being shown in dotted lines.

Figure 2:
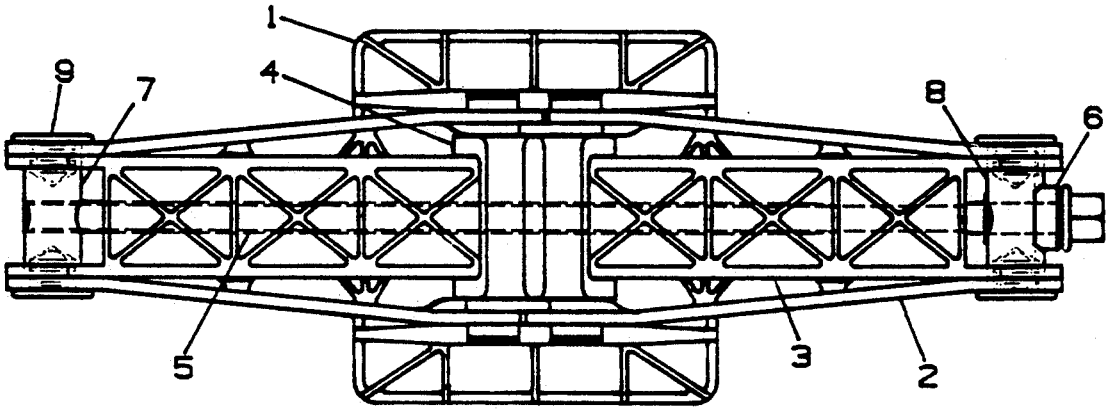
FIG. 2 is a top view of the plastic jack of this invention.
Figure 3:
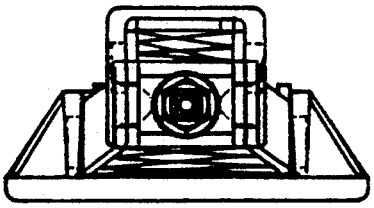
FIG. 3 is an end view of the plastic jack of this invention.

In FIG. 2, a thrust bearing (6) is shown centrally located transversely in a drilled trunnion (8) which spans the right hand joint of the lower and upper channel links (2) and (3). The thrust bearing (6) rotatably locates one end the operating screw in the trunnion (8) to control the position of the right hand joint of the lower and upper channel links (2) and (3). The drilled trunnion (8) helps to maintain the separation of the ends of the channel links and to form an axle upon which the right-hand lower and upper channel links (2) and (3) pivot. On the other side, the left-hand lower and upper channel links (2) and (3) pivot on a threaded trunnion (7) which cooperates with the screw (5) to move the trunnion (7) longitudinally along the shaft of the screw (5) to separate or to draw together the two trunnions. The threaded trunnion (7) and the drilled trunnion (8) cooperate with the operating screw (5) to adjust the horizontal position of the trunnions (7) and (8) with respect to each other thereby lifting or lowering the load rest (4) in relation to the base (1). Retainer caps (9) close both ends of the threaded trunnion (7) and drill trunnion (8).

Figure 4:
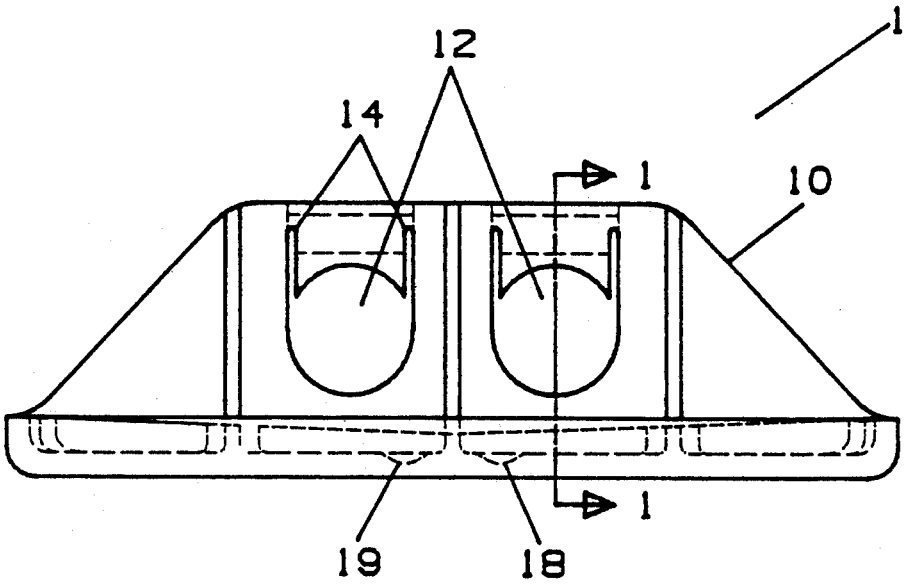
FIG. 4 is a side view of the base element of the plastic jack combination of this invention.
Figure 5:
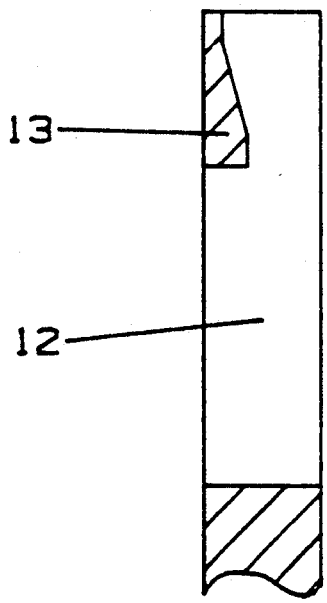
FIG. 5 is a sectional view taken through Section BB of FIG. 4 illustrating the snap fit connection feature of the base.
Figure 6:
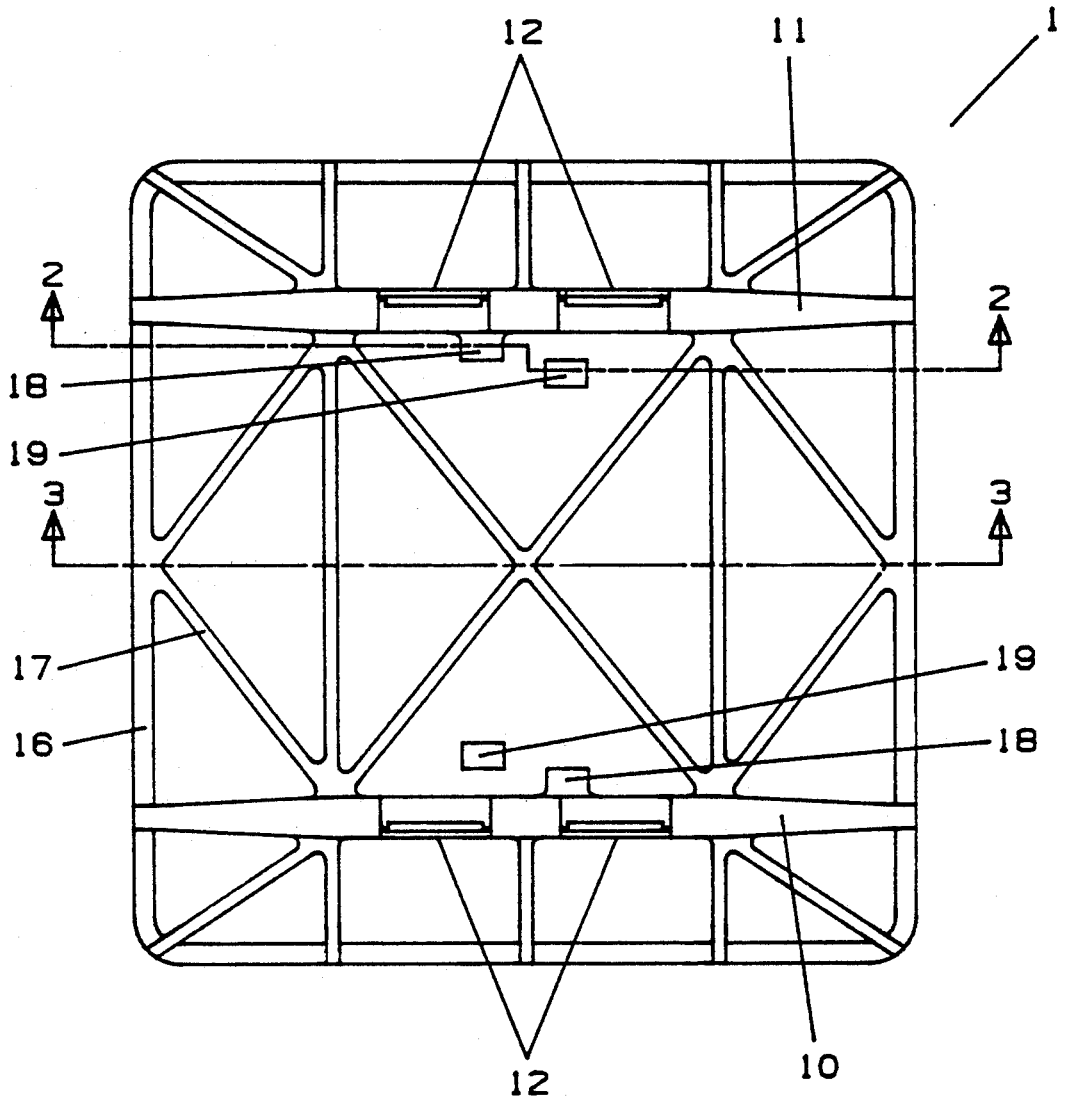
FIG. 6 is a top view of the base of the plastic jack of this invention.
Figure 7:
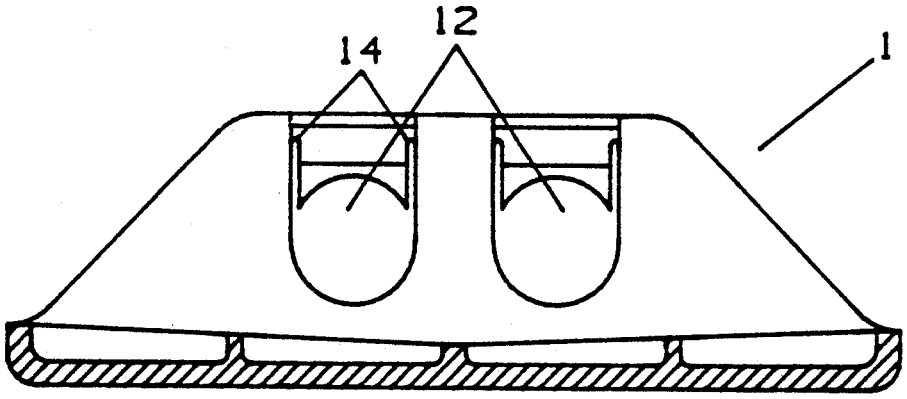
FIG. 7 is a sectional view taken along Section lines AA illustrating the central profile of the base.
Figure 8:
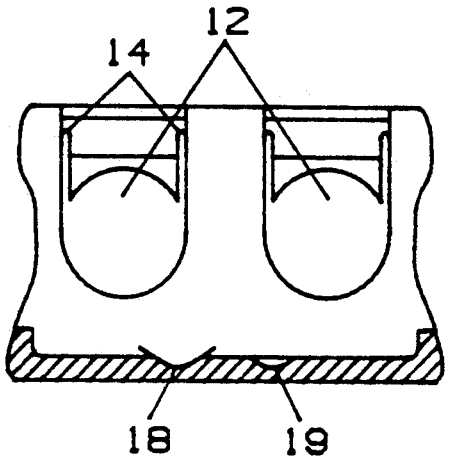
FIG. 8 is a sectional view taken along Section line CC of FIG. 6 illustrating the clearance in the base for the pivoting arms of the lower channel links.
Figure 9:
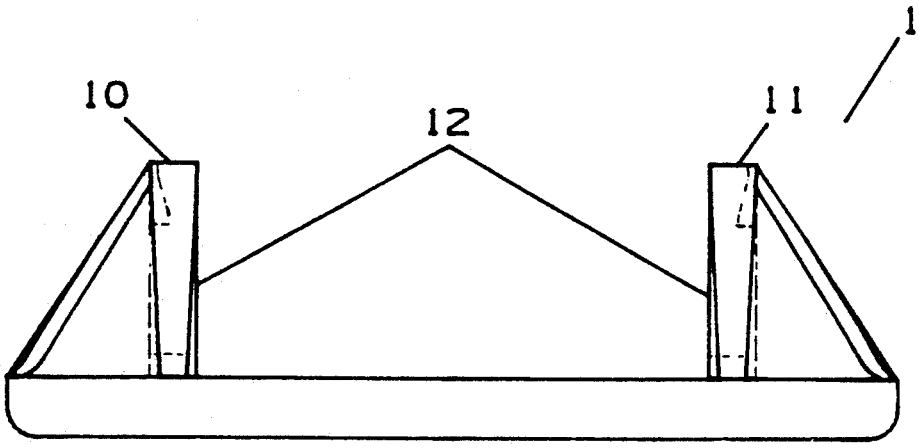
FIG. 9 is an end view of the base.
Figure 10:
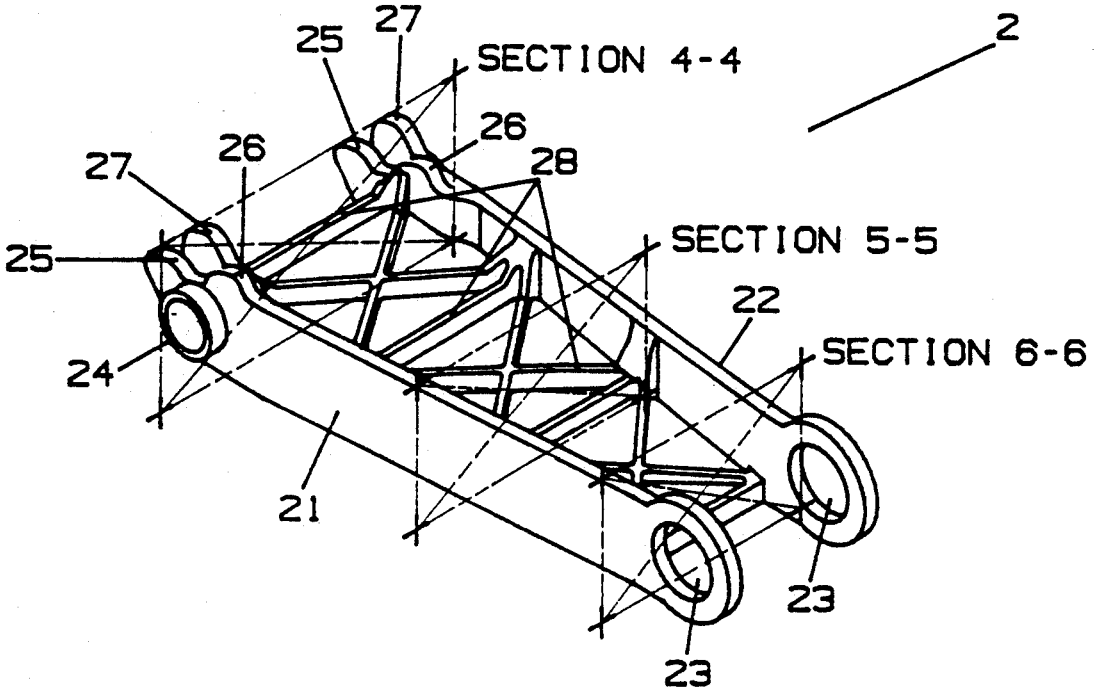
FIG. 10 is a perspective view of a lower channel link of this invention.

The base (1) of the jack assembly is further illustrated in FIGS. 4 through 9. As illustrated in FIG. 4, the side profile of the base (1) is approximately trapezoidal in shape. As illustrated in FIGS. 4, 6 and 9, the raised portion of the base (1) comprises two vertical sections (10) and (11) which each contain snap-fit openings (12) which are adapted to receive the lower channel links (2) in a snap-fit connection.

As illustrated in FIG. 5, each opening (12) comprises a round hole topped by a depending lug (13) having an inclined surface to receive the lower channel link (2) in snap-fit connection. As best illustrated in FIGS. 4, 7 and 8, each lug (13) is partially cut away from sections 10 and 11 and separated therefrom by means of slots (14) to facilitate bending of lug (13) as a lower channel link (2) is slid over the inclined surface to effect the snap-fit connection.

As illustrated in FIG. 6, the base (1) has an outer perimeter (16) upon which sections (10) and (11) are erected. Struts (17) from a grid structure to reinforce the outer perimeter (16) and to support the sections (10) and (11).

As illustrated in FIGS. 4, 6 and 8, pockets (18) and (19) are provided in the base to allow clearance for the gear teeth of the lower channel links (see FIG. 1).

A lower channel link of this invention is illustrated in FIGS. 11 through 19. Each of the two lower channel links is identical to the other and, accordingly, a description of one will constitute a description of both of them.

The lower channel link (2) of this invention is illustrated in FIGS. 10 through 19. As illustrated in the perspective view of FIG. 10, the lower channel link comprises a first side section (21) and a second side section (22). Each of the side sections (21) and (22) has a trunnion hole (23) adapted to receive either the threaded trunnion (7) or the drilled trunnion (8) as illustrated in FIG. (2). At the opposite end of each section (21) and (22), is a annular projection (24) adapted to be received in the snap-fit connection holes (12) of the base (1) (see FIGS. 4–9). Geared teeth (25), (26) and (27) are also located adjacent the annular projection (24). A web of supporting struts (28) is used to connect the side sections (21) and (22) in a rigid structure. The web of supporting struts (28) inclines downward from a central portion of the side sections (21) and (22) near the geared teeth (25), (26) and (27) towards the holes (23). Further details of the web structure may be appreciated from FIGS. 16, 17, 18 and 19 which depict sectional views through the lower channel link (2).

Figure 11:
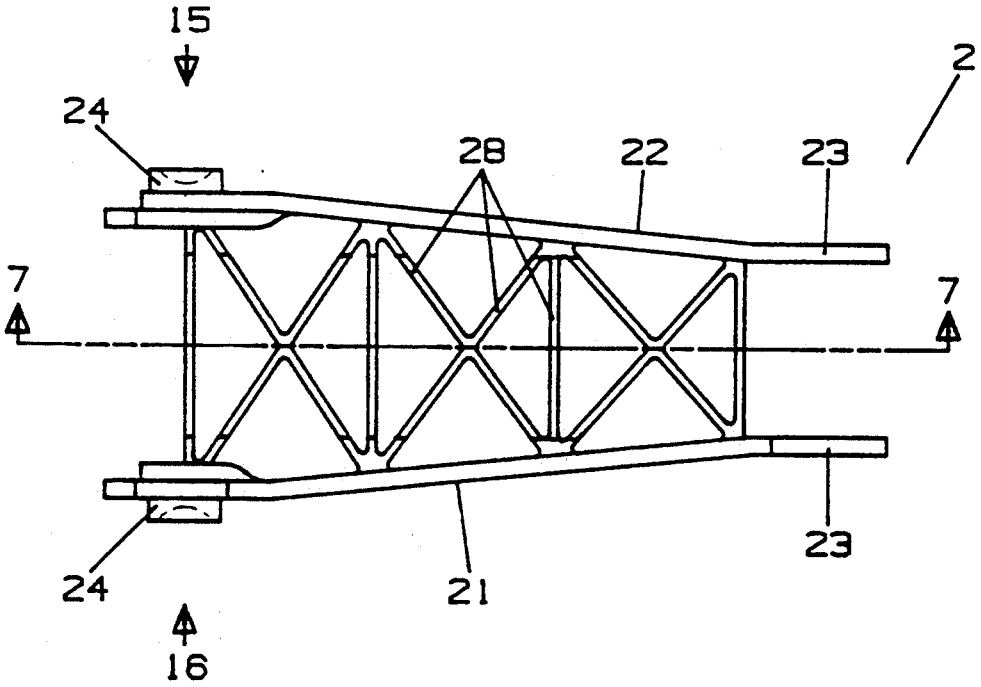
FIG. 11 is a top view of the lower channel link of this invention.
Figure 12:
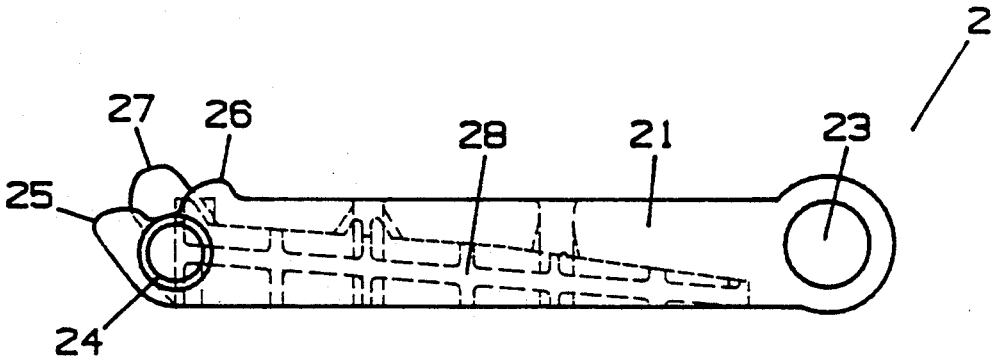
FIG. 12 is a side view of the lower channel link of this invention.
Figure 13:
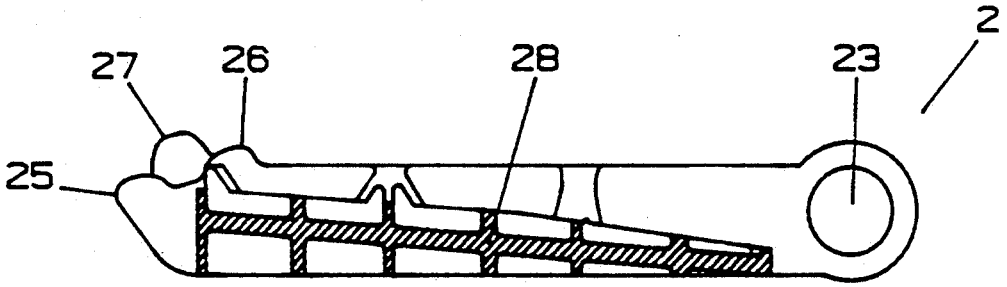
FIG. 13 is a sectional view taken along Section lines AA of FIG. 11 of this invention showing the interior of the lower channel link.
Figure 14:
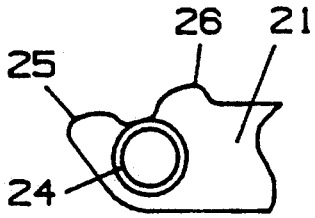
FIG. 14 is a detail view of one set of geared teeth of the lower channel link of this invention viewed in the direction of arrow B in FIG. 11.
Figure 15:
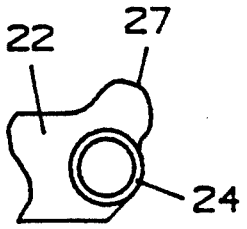
FIG. 15 is a detail of the other geared teeth of the lower channel link of this invention viewed in the direction of arrow F in FIG. 11.
Figure 16:
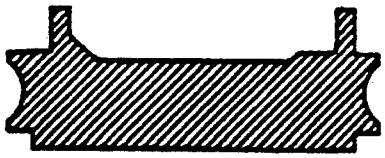
FIG. 16 is a sectional view of the lower channel link of this invention taken along lines CC in FIG. 10.
Figure 17:
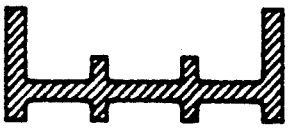
FIG. 17 is a sectional view taken along lines DD in FIG. 10.
Figure 18:
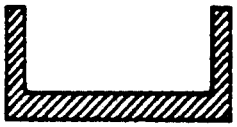
FIG. 18 is a sectional view taken along lines EE in FIG. 10.
Figure 19:
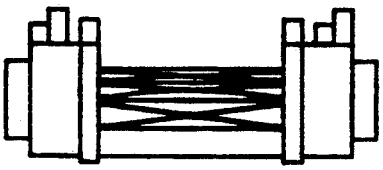
FIG. 19 is an end view of the lower channel link of this invention.
Figure 20:
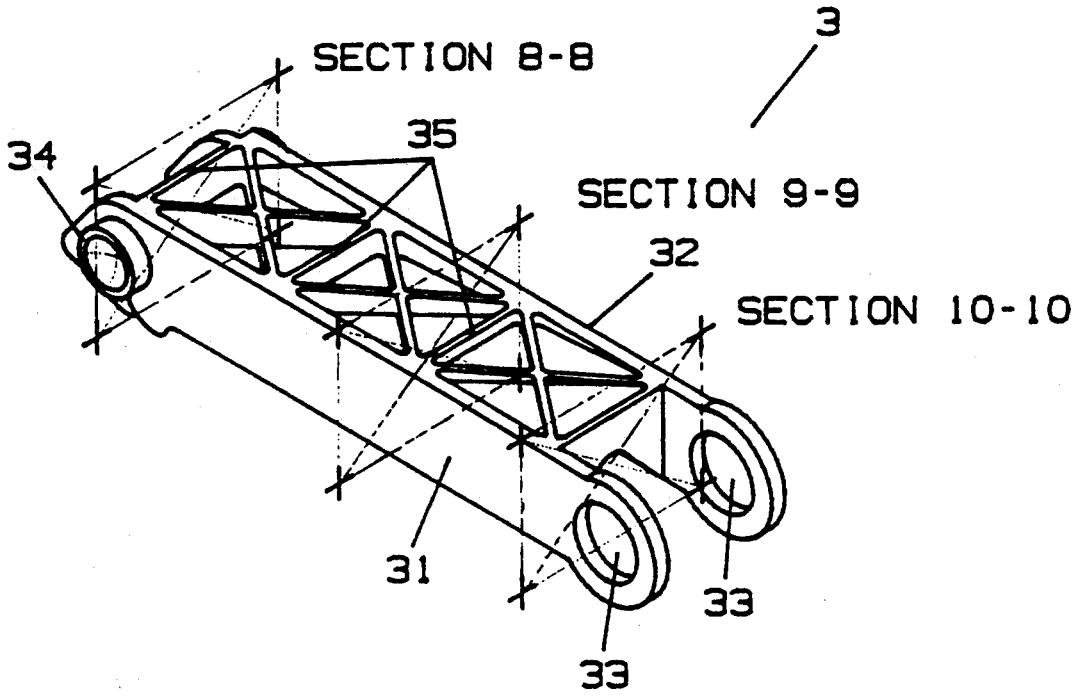
FIG. 20 is a perspective view of the upper channel link of this invention.
Figure 21:
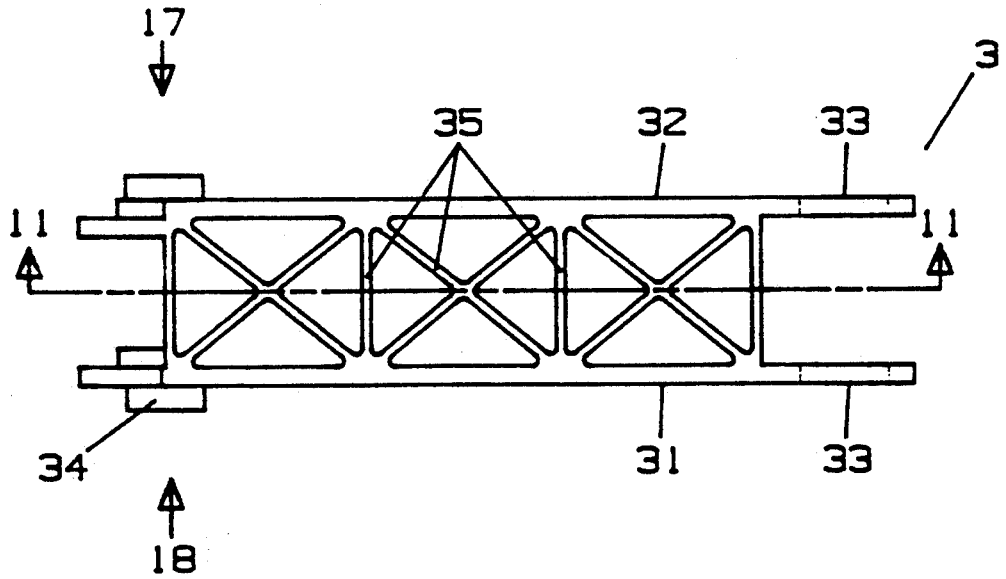
FIG. 21 is a top view of the upper channel link of this invention.

Further details of the geared teeth of the lower channel link are illustrated in FIGS. 14 and 15 which depict views of the geared teeth taken in the directions of arrow B and arrow F in FIG. 11, respectively. It may be seen from FIG. 14 that geared teeth (25) and (26) lie in the same plane while geared tooth (27) lies in a next adjacent plane (see also FIG. 10). Geared teeth (25) and (26) also always lie to the left of geared tooth (27) on both sections (21) and (22). Accordingly, the geared teeth (25) and (26) of one lower channel will mesh with the geared tooth (27) of another lower channel when both lower channel links are snapped into the base (1) as illustrated in FIGS. 1 and 2. The tooth profile of the geared teeth (25), (26) and (27) is established to ensure smooth meshing of the tooth (27) within geared teeth (25) and (26) as the lower channel links (2) rotate about the annular projections (24) in the holes (12) of the base (1). It will be appreciated by those skilled in the art how the tooth profile curvature should be constructed in order to achieve smooth meshing. A preferred embodiment of this invention will have the tooth profile illustrated in FIGS. 14 and 15.

As illustrated in FIG. 6, the cavities (18) and (19) of the base (1) permit rotation of the geared teeth (25) and (27) into the base in order to maintain a low profile for the jack.

Figure 22:
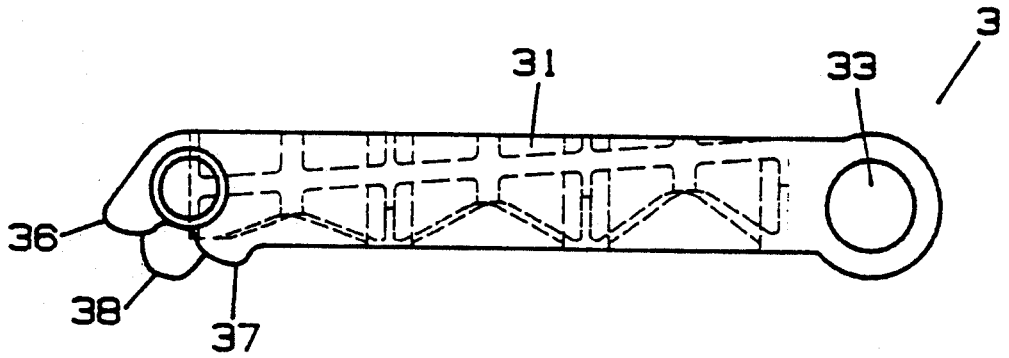
FIG. 22 is a side view of the upper channel link of this invention.
Figure 23:
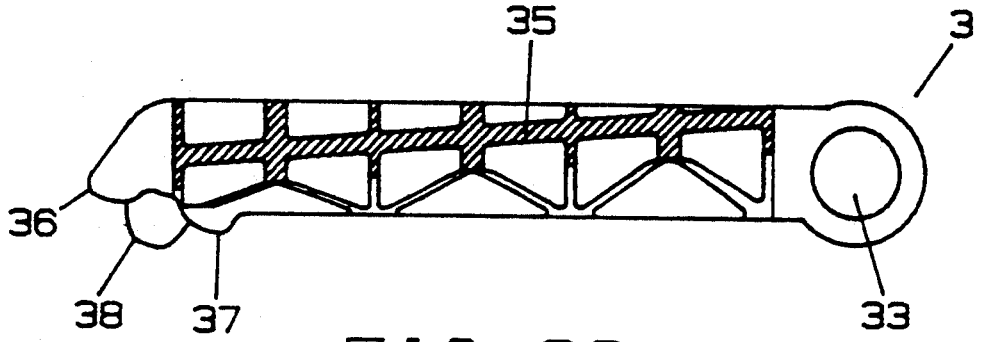
FIG. 23 is a sectional view taken along section lines AA in FIG. 21 illustrating the profile of the central portion of the upper channel link of this invention.
Figure 24:
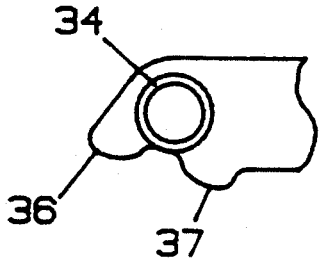
FIG. 24 is a detail of the geared teeth of the upper channel link of this invention taken in the direction of arrow B in FIG. 21.
Figure 25:
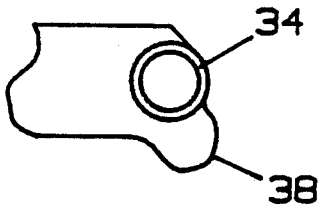
FIG. 25 is a detail of the geared teeth of the upper channel link of this invention taken in the direction of arrow F in FIG. 21.
Figure 26:
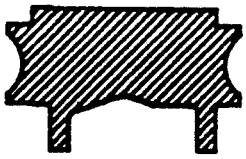
FIG. 26 is a view of the upper channel link of this invention taken along section lines CC of FIG. 20.
Figure 27:
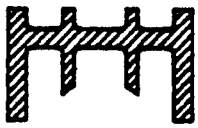
FIG. 27 is a sectional view of the upper channel link of this invention taken along lines DD of FIG. 20.
Figure 28:
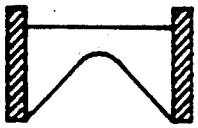
FIG. 28 is a sectional view of the upper channel link of this invention taken along lines EE of FIG. 20.
Figure 29:
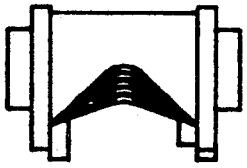
FIG. 29 is an end view of the upper channel link of this invention.
Figure 30:
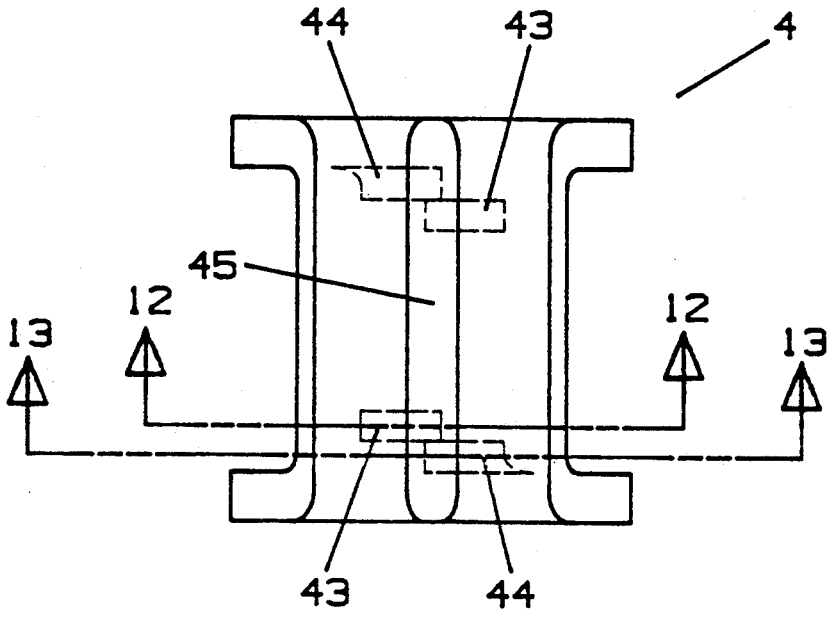
FIG. 30 is a top view of the load rest of this invention.
Figure 31:
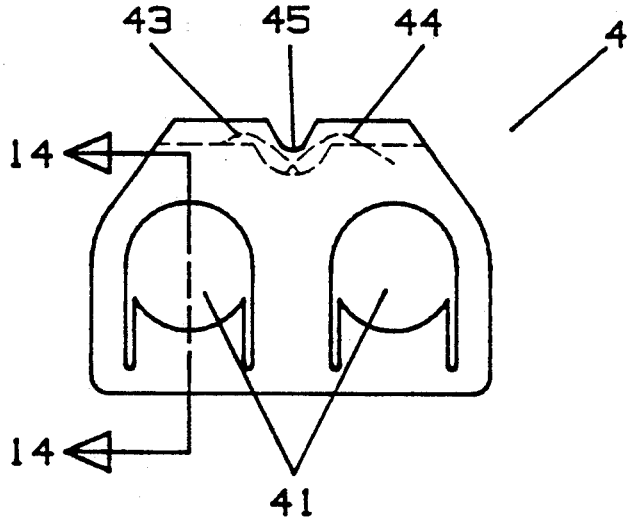
FIG. 31 is a side view of the load rest of this invention.
Figure 32:
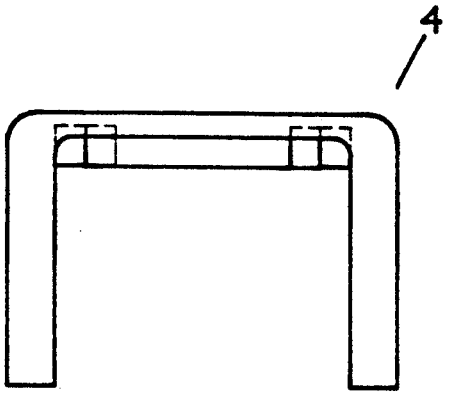
FIG. 32 is an end view of the load rest of this invention.
Figure 33:
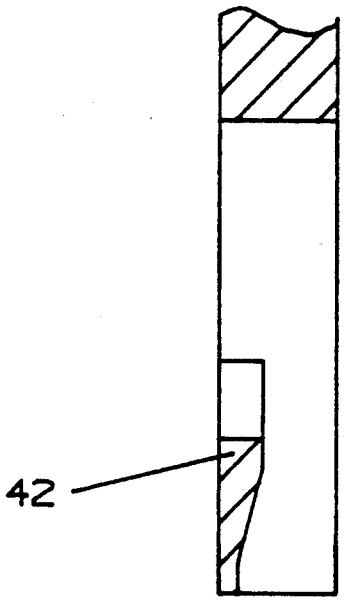
FIG. 33 is a sectional view taken along section lines CC in FIG. 31 of the load rest of this invention.

The upper channel links (3) of this invention are constructed similar to the lower channel links and are illustrated in FIGS. 20 through 29. Looking at FIG. 20, each upper channel link (3) has a first side section (31) and a second side section (32), trunnion holes (33) and annular projections (34), similar to that seen in the lower channel link (2). Each side section (31) and (32) are joined by supporting struts (35). As best illustrated in FIGS. 22 and 23, each of the side sections (31) and (32) has geared teeth (36), (37) and (38). As illustrated in FIGS. 24 and 25, the geared teeth (36) and (37) lie in one plane while the geared tooth (38) lies in an adjacent plane. When two upper channel links are erected on the lower channel links by connection about the trunnions (7) and (8) through the holes (33), the geared teeth (36) and (37), mesh with a geared tooth (38) of the opposing upper channel link. Again the profiles of the geared teeth ensure smooth rotation of the geared teeth within one another as the upper channel links rotate with respect to one another. The supporting struts (35) as illustrated in FIGS. 22, 23 and 26 through 29 move from an "I"-beam construction near the geared teeth to a "U"-beam construction near the pole (33) in order to maintain the necessary clearance for smooth action and low profile.

Figure 34:
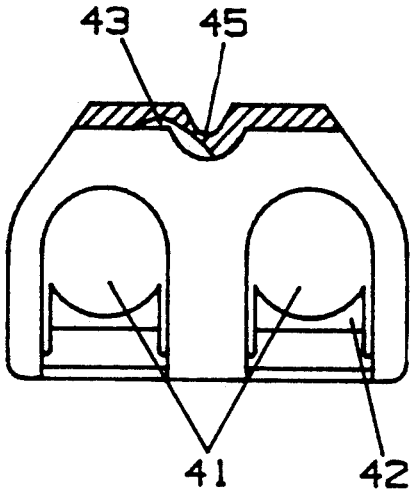
FIG. 34 is an enlarged view taken along section lines AA in FIG. 30 of this invention.
Figure 35:
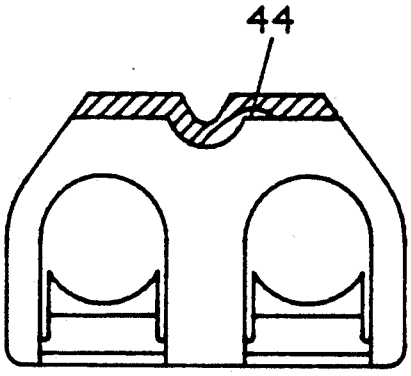
FIG. 35 is an enlarged view taken along section lines BB in FIG. 30 illustrating the load rest of this invention.

The load rest (4) of this invention is shown in FIGS. 30 through 35. The load rest (4) as illustrated in a side view of FIG. 31 has snap fit connection holes (41) adapted to receive the annular projections (34) of the upper channel link (3) in a snap fit connection over the inclined lug (42) which may be seen in cross section in FIG. 33. The inclined surface of lug (42) permits the annular projection (34) to press the lug (42) inward as the annular projection (34) advances until it reaches the hole (41) at which point the lug (42) snaps back about the annular projection (34) to lock it into position in hole (41). As illustrated in FIGS. 34 and 35, which are sectional views taken through lines AA and BB respectively of FIG. 30, the load rest (4) has bearing surfaces (43) and (44) adapted to mesh with the geared teeth (36) of each of the upper channel links (3). The load rest (4) also has a slot (45) across its upper surface which acts as a catch to locate the jack under the chassis of an automobile.

Figure 36:
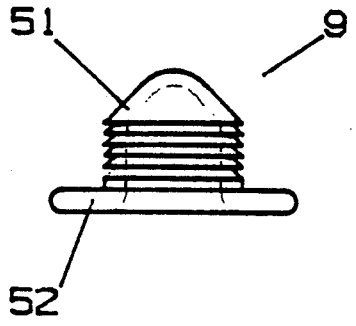
FIG. 36 is a side view of a retainer cap of this invention.
Figure 37:
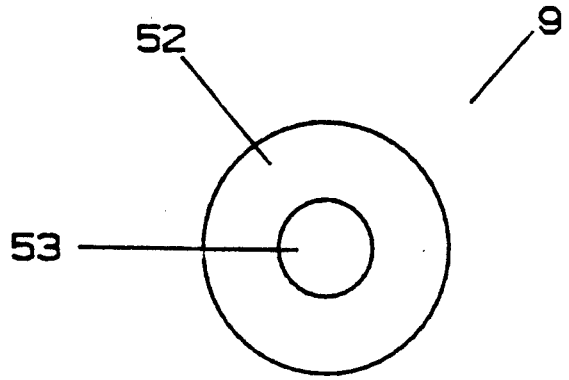
FIG. 37 is a end view of the retainer cap of this invention.

FIGS. 36 and 37 illustrate a retainer cap (9) having a projection (51) adapted to friction fit within the trunnions (7) and (8) and the holes (23) and (33) of the lower and upper channel links respectively and the annular projections (24) and (34) of the lower and upper channel links respectively. A flat disk (52) acts as a stop for the retainer cap (9). In the preferred embodiment the retainer cap is hollowed out by a hole (53).

The embodiments of this invention in which an exclusive property and privilege is claimed are:

1. A pantograph jack comprising;

a plastic base having connection means to receive each of two lower channel links in a pivotable connection, two plastic lower channel links each having a first side section and a second side section joined by a grid of support struts, said first side section having a lower end with connection means to connect to the base and first and second gear teeth in a first plane and a third gear tooth in another next adjacent second plane; and having an upper end with connection means to connect pivotally to an upper channel link;

said second side section having a lower end with fourth and fifth gear teeth in a third plane and a sixth gear tooth in another next adjacent fourth plane, said third and fourth planes being in the same relationship to one another as said first and second planes, and said first and second gear teeth being shaped and spaced to mesh with the sixth tooth of a reversed and opposed lower channel link connected to the base, said fourth and fifth gear teeth being shaped and spaced to mesh with a third tooth of a reversed and opposed lower channel link connected to the base, two plastic upper channel links each having a first side section and a second side section joined by a grid of support struts, said first side section having an upper end with connection means to connect to a load rest and first and second gear teeth in a first plane and a third gear tooth in another next adjacent second plane; and having an upper end with connection means to connect pivotally to a lower channel link;

said second side section having an upper end with connection means to connect to a load rest and with fourth and fifth gear teeth in a third plane and a sixth gear tooth in another next adjacent fourth plane, said third and fourth planes being in the same relationship to one another as said first and second planes, and said first and second gear teeth being shaped and spaced to mesh with the sixth tooth of a reversed and opposed upper channel link connected to the load rest, said fourth and fifth gear teeth being shaped and spaced to mesh with a third tooth of a reversed and opposed upper channel link connected to the load rest and a load rest having connection means to receive each of two upper channel links in a pivotable connection.

* * * * *